United States Patent [19]

Crago

[11] 4,075,963

[45] Feb. 28, 1978

[54] SKELETON DISCHARGE MECHANISM FOR USE WITH CUPMAKER BLANK AND DRAW PRESSES AND THE LIKE

[75] Inventor: Terril M. Crago, Long Beach, Calif.

[73] Assignee: Standun, Inc., Compton, Calif.

[21] Appl. No.: 640,938

[22] Filed: Dec. 15, 1975

[51] Int. Cl.[2] ..... B21D 43/00; B21C 1/14

[52] U.S. Cl. ..... 113/113 R; 72/336; 72/423; 198/728

[58] Field of Search ..... 113/113 R; 72/336, 422, 72/423, 361, 337; 198/173; 83/923, 111, 112, 154, 155, 423

[56] References Cited

U.S. PATENT DOCUMENTS

| | | | |
|---|---|---|---|
| 2,015,987 | 10/1935 | Bayer | 113/113 R |
| 2,514,819 | 7/1950 | Wilckens | 113/113 R |
| 2,598,028 | 5/1952 | Andrew et al. | 113/113 R |
| 3,282,407 | 11/1966 | Schermund | 198/173 X |
| 3,417,596 | 12/1968 | Richter | 113/113 R X |
| 3,800,583 | 4/1974 | Miller | 113/113 R X |
| 3,874,216 | 4/1975 | Ames | 113/113 R X |

*Primary Examiner*—Leon Gilden

*Attorney, Agent, or Firm*—Mahoney, Schick & Cislo

[57] ABSTRACT

The skeleton discharge mechanism receives the leading edge portion of scrap skeleton sheets one at a time from a press at an entrance portion of a support surface exactly positioned by the press relative to a pick-up station and transversely spaced pairs of engagement members move partially upwardly through the support surface on a timed basis to engage the sheet leading edge through press formed part openings. The engagement members are secured to chains constantly moving over sets of sprockets along closed paths and after engaging the sheet leading edge move longitudinally along the support surface to a surface exit portion pulling or dragging the sheet through the mechanism. At the surface exit portion, the engagement members move downwardly in their closed paths disengaging the sheet which continues on to discharge and the engagement members continuing on in their closed paths move forwardly spaced beneath the support surface and ultimately to the pick-up station ready for engagement on the timed basis with the leading edge portion of a next scrap skeleton sheet that has now arrived at the pick-up station. Selectively adjustable side edge guides of the support surface are provided for adapting the mechanism to different widths of scrap skeleton sheets, and certain of the sprockets are selectively adjustable for changing the exact longitudinal locations of sheet engagement by the engagement members to vary the pick-up station adapting the mechanism to various sheet longitudinal lengths.

4 Claims, 8 Drawing Figures

SKELETON DISCHARGE MECHANISM FOR USE WITH CUPMAKER BLANK AND DRAW PRESSES AND THE LIKE

BACKGROUND OF THE INVENTION

This invention relates to a skeleton discharge mechanism for use with various types of blanking presses such as cupmaker blank and draw presses and the like. More particularly, the skeleton discharge mechanism of the present invention is uniquely constructed capable of discharging scrap skeleton sheets on a completely positive basis at a timed rate compatible with modern production presses. According to the present invention, the mechanism operates to securely engage a leading edge portion of each scrap skeleton sheet as the press operations thereon are completed, and during maintainment of such secure engagement, positively moves the scrap skeleton sheet through the scrap discharge mechanism and therefrom to final discharge. In a preferred optimum form, the mechanism is preferably fully selectively adjustable for adapting the same to a wide range of different scrap skeleton sheet sizes so that a single model of such mechanism through these selective adjustments is usable with various different dies of a given press or various different presses.

Many forms of skeleton discharge mechanisms have heretofore been provided incorporated directly in or as separate auxiliary equipment with various types of solely blanking or combined blank and draw presses. One very common use of blank and draw presses is in the manufacture of two-piece metallic can bodies, that is, a single-piece can body with integral side and bottom walls sealed by a can end after filling with its intended contents. In any event, all such presses produce scrap skeleton stock either in sheet or strip form requiring subsequent discharge and ultimate disposal.

Although coil fed, continuous strip blank and presses are used in the can making industry and the principals of the present invention would have certain application therewith, a large number of sheet fed blank and draw presses are likewise used. For instance, due to certain technicalities of adding and maintaining coated surfaces of the materials, it is necessary that the material supplied to the blank and draw presses will be separate sheet form. Thus, although again it is clear to those skilled in the art that most of the same problems exist with coil fed blank and draw presses, the present discussion is confined to sheet fed blank and draw presses.

With sheet fed blank and draw presses, the sheets are fed at appropriate time intervals, one at a time, longitudinally into proper start position in the blank and draw press. On the first stroke of the press, transverse rows of cup blanks, usually two or more rows appropriately spaced and internested for maximum material usage, are removed from the sheet at the leading edge portion thereof. At the completion of the first press stroke and during initiation of the second press stroke, the sheet is indexed longitudinally by the press exposing longitudinally adjacent sheet material for removal of a second multiplicity of cup blanks, such press stroking and sheet indexing continuing, usually five or six times, until the trailing end portion of the sheet is reached and the last rows of cup blanks are removed. The result is that as the last press stroke is completed for a given sheet, the leading edge portion of the sheet projects longitudinally from the press and the entire sheet is filled with a maximum number of closely spaced cup blank or part holes thereby constituting a scrap skeleton sheet.

It is the problems involved from this stage of operation on with which the principals of the present invention are involved, that is, just how to remove these scrap skeleton sheets from the press on a consecutive basis. One of the problems encountered is occasioned by the fact that modern day metallic cans, whether the shallow food containers or the deeper beverage containers, are formed from extremely thin metal in the order of a few thousandths of an inch so that the scrap skeleton sheets in widths up to about forty-two inches and lengths up to about forty-four inches comprised of a maximum of holes interconnected by thin metal sections are extremely fragile. It is virtually impossible to push these fragile scrap skeleton sheets from the press since they are not of sufficient overall rigidity to withstand such forces from these locations, although such is occasionally done with the aid of gravity where it is possible to tilt the press to a relatively sharp angle but which, in operations of the type herein involved, presents many additional problems.

A second important factor involves the small time interval permitted for removal of these fragile scrap skeleton sheets from the press in modern press operations and particularly in modern can cupmaker blank and draw press operations. For instance, a modern can cupmaker blank and draw press operates at speeds in the order of one hundred to one hundred ten strokes or cycles per minute and with five sheet indexes to complete each sheet and produce a scrap skeleton sheet. This means that the scrap skeleton sheets must be discharged or removed from the press at the rate of twenty to twenty-two sheets per minute. Assuming the minimum rate of operation, the time interval allowed for the complete removal of a scrap skeleton sheet from the press is three seconds and it is obvious that any attempt to frictionally engage the scrap skeleton sheet, such as with friction rolls, and accelerate the same from its stationary position to movably discharge it from the press would be completely undependable, if not impossible resulting in serious complications to press dies and other equipment upon any failure.

OBJECTS AND SUMMARY OF THE INVENTION

It is, therefore, an object of this invention to provide a skeleton discharge mechanism for use with presses such as cupmaker blank and draw presses and the like wherein scrap skeleton sheets are discharged consecutively from the press on a completely positive basis at speeds compatible with the modern high speed presses and in a manner obviating the possibilities of failure which have been prevalent with the prior mechanisms. Of most importance to the principals of the present invention, as the press operations on the particular sheet are completed, the sheet is positioned with the leading edge portion thereof projecting longitudinally into the skeleton discharge mechanism and this leading edge portion thereof is directly engaged by the mechanism. Through this direct engagement, the skeleton discharge mechanism is then pulled or dragged from the press and thereby moved longitudinally to ultimate discharge. As a result, not only is direct engagement with the scrap skeleton sheet established and maintained to assure positive movement of the sheet from the press, but such direct engagement being at the sheet leading edge portion and the sheet motion established by pulling or dragging eliminates the inherent fragility of the sheet from causing difficulties in establishing such discharge motion from collapse or undue distortion of the sheet.

According to a preferred embodiment of the skeleton discharge mechanism of the present invention, the discussed direct engagement by the mechanism with the scrap skeleton sheet leading edge portion is through one or more engagement members which move in a closed longitudinal path into engagement with the sheet leading edge through preformed sheet openings and then along a mechanism support surface pulling the sheet through the mechanism for discharge. During discharge of the scrap skeleton sheet, the engagement member or members move away from the mechanism support surface disengaging the sheet and ultimately moved back to reengagement with a following scrap skeleton sheet to be extracted from the press and discharged. In the optimum form of the present invention, the engagement members move in the described closed longitudinal path continuously, that is, without stopping and restarting, and their motion is timed with the press operation for proper press and consecutive scrap skeleton sheet discharge, thereby providing a skeleton discharge mechanism of maximum simplicity and not requiring complex controls once the continuous timing is established.

It is a further object of this invention to provide a skeleton discharge mechanism of the foregoing general use and having the above discussed advantages which, again in the preferred form, is fully selectively adjustable for adapting the same to different sizes of scrap skeleton sheets. In this manner, the skeleton discharge mechanism may be selectively adjusted for performing the same positive discharge function of scrap skeleton sheets formed from different die arrangements of a particular press. Furthermore, this same selective adjustability provides adaption thereof to completely different presses requiring discharge of scrap skeleton sheets within reasonable size limitations.

In the preferred embodiment of the skeleton discharge mechanism as hereinbefore described, the scrap skeleton sheet is pulled along a mechanism support surface and to ensure positive sheet movement, the support surface is provided with sheet edge guides and these sheet edge guides are mounted selectively transversely adjustable to adapt the mechanism to sheets of varying widths. Also, with the described engagement member or members moving in the predetermined closed longitudinal path during the functioning of the mechanism, additional adjustment means is provided for selectively varying the exact longitudinal location at which the engagement member or members are brought into engagement with the particular scrap skeleton sheet leading edge portion. In this manner, therefore, the mechanism may be adapted by selective adjustment thereof to scrap skeleton sheets of different longitudinal lengths while still maintaining the positive movement and discharge thereof through and from the mechanism.

Other objects and advantages of the invention will be apparent from the following specification and the accompanying drawings which are for the purpose of illustration only.

DESCRIPTION OF THE BEST EMBODIMENT CONTEMPLATED

Figure 2:
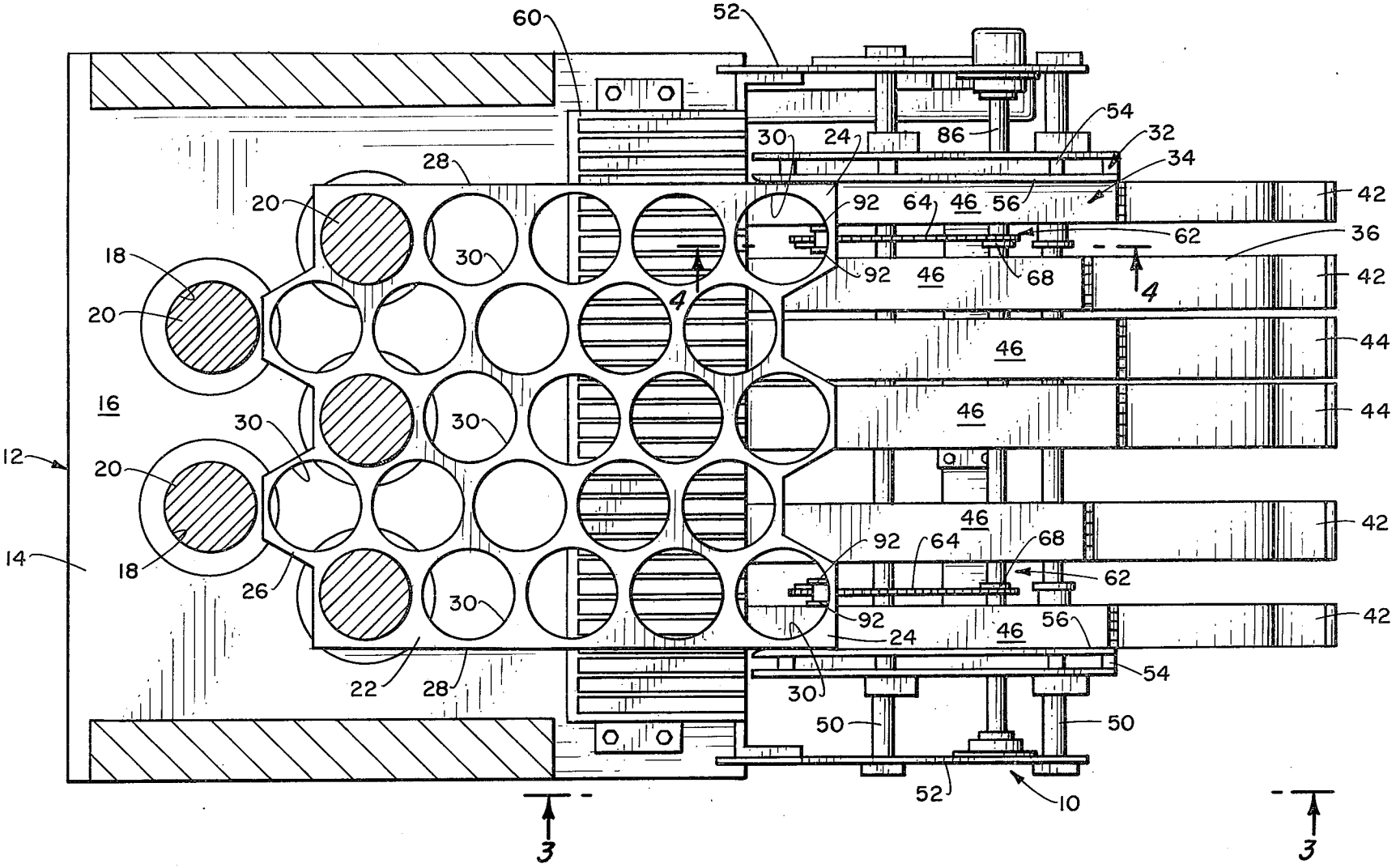
FIG. 2 is an enlarged top plan view looking in the direction of the arrows 2—2 in FIG. 1 and showing the skeleton discharge mechanism with upper guide portions removed to reveal internal parts thereof and showing the press partially in horizontal section.

Referring to the drawings, a preferred embodiment of the skeleton discharge mechanism of the present invention is generally indicated at 10 and is shown mounted on and in working relationship with a typical metallic can cupmaker blank and draw press generally indicated at 12. As can be particularly seen in FIG. 2, the press 12 is shown herein with a blank and draw die generally indicated at 14 having an upper horizontal surface 16 and five die cavities 18, the latter arranged into longitudinally spaced, transversely extending rows so that five metallic cups are blanked and drawn in each press stroke. In FIG. 2, the die cavities 18 are shown with vertically reciprocal rams 20 received therein, the rams being in vertical cross sections.

Furthermore, a thin gauge, metallic, scrap skeleton sheet generally indicated at 22 is shown on the die surface 16 of the die 14 just having had the last cup blanks removed therefrom so that the scrap skeleton sheet is complete and ready for discharge upon the upward withdrawal of the rams 20. More particularly, the scrap skeleton sheet 22 includes a leading end portion 24, a trailing end portion 26, generally parallel and longitudinally extending side edges 28, and a multiplicity of transversely extending rows of somewhat internested cup or part openings 30. The cup or part openings 30 in number are, of course, multiples of the die cavities 18 and in this case, the number of part openings is five times the number of die cavities requiring five press strokes with intermediate sheet indexing to complete one scrap skeleton sheet 22.

Figure 1:
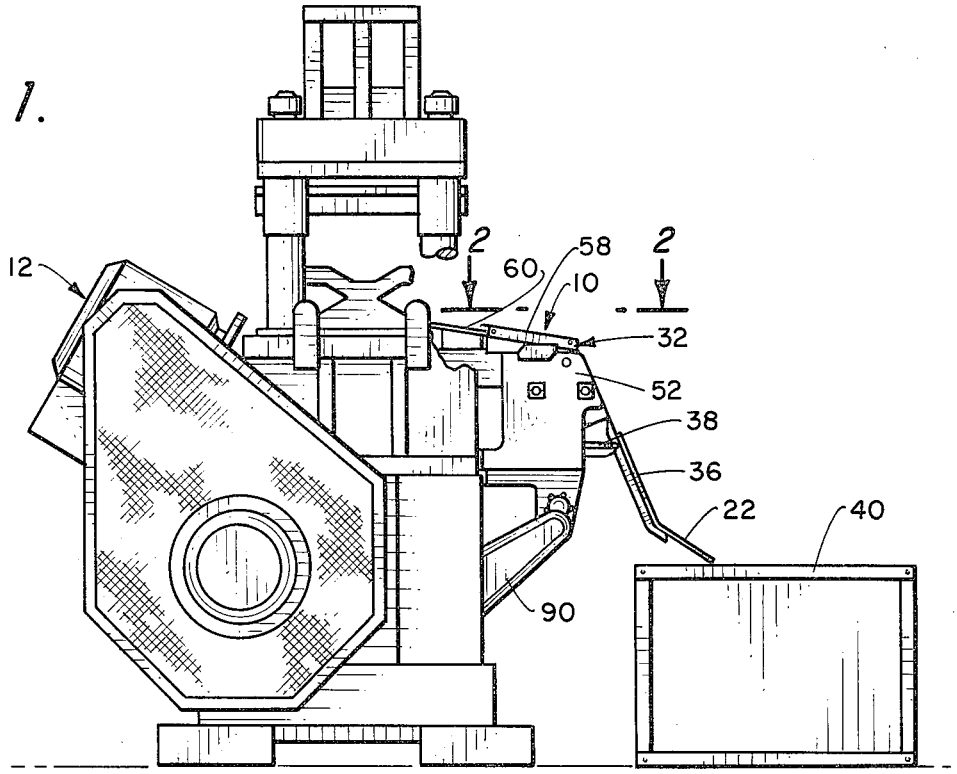
FIG. 1 is a side elevational view of a typical metallic can cupmaker blank and draw press having a preferred embodiment of the skeleton discharge mechanism of the present invention operably mounted therewith and discharging scrap skeleton sheets therefrom into a receiving scrap bin.
Figure 3:
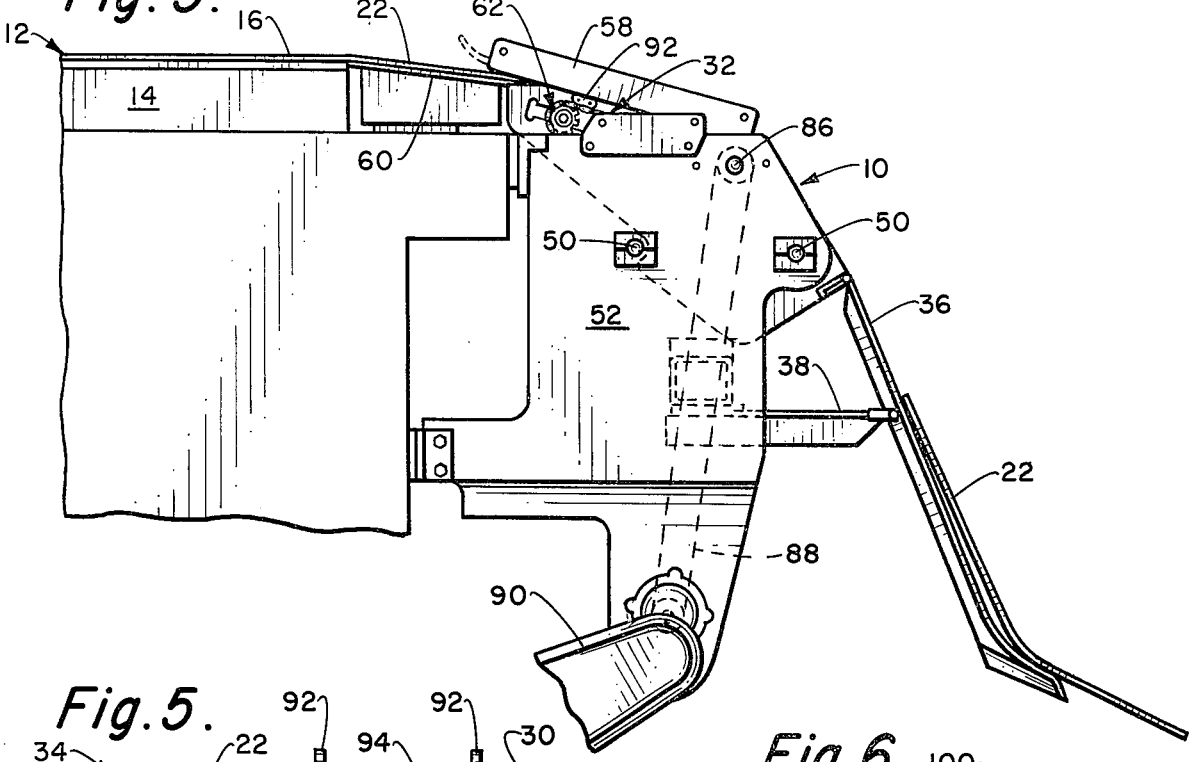
FIG. 3 is a reduced, fragmentary, side elevational view looking in the direction of the arrows 3—3 in FIG. 2.
Figure 5:
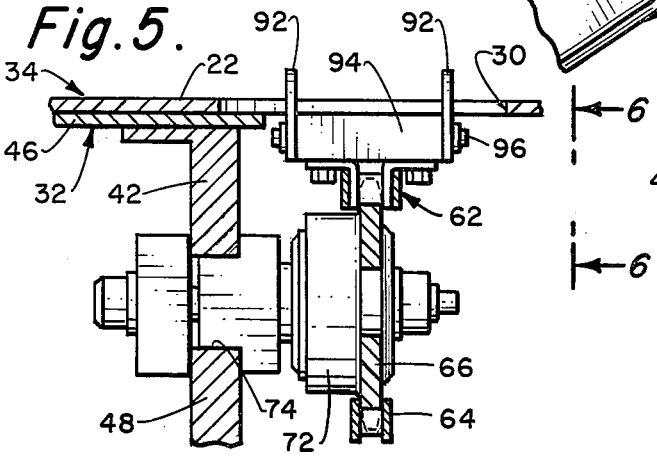
FIG. 5 is an enlarged, fragmentary, vertical sectional view looking in the direction of the arrows 5—5 in FIG. 4.

The skeleton discharge mechanism 10 is rigidly connected to the press 12 as can be seen in FIGS. 1 through 3 and includes a longitudinally extending sheet support surface tray generally indicated at 32 having an upwardly exposed, generally longitudinally extending, sheet support surface generally indicated at 34. The sheet support tray 32 and the support surface 34 thereof are angled slightly downwardly in their extension away from the press 12 and then are angled more sharply downwardly to a support tray extension 36 hingedly connected to the sheet support tray. The support tray extension 36 is retained in a selected hinged position by adjustable rods 38 so as to finally direct the discharge of scrap skeleton sheets into any appropriate container, such as the usual bin 40 (FIG. 1).

Figure 4:
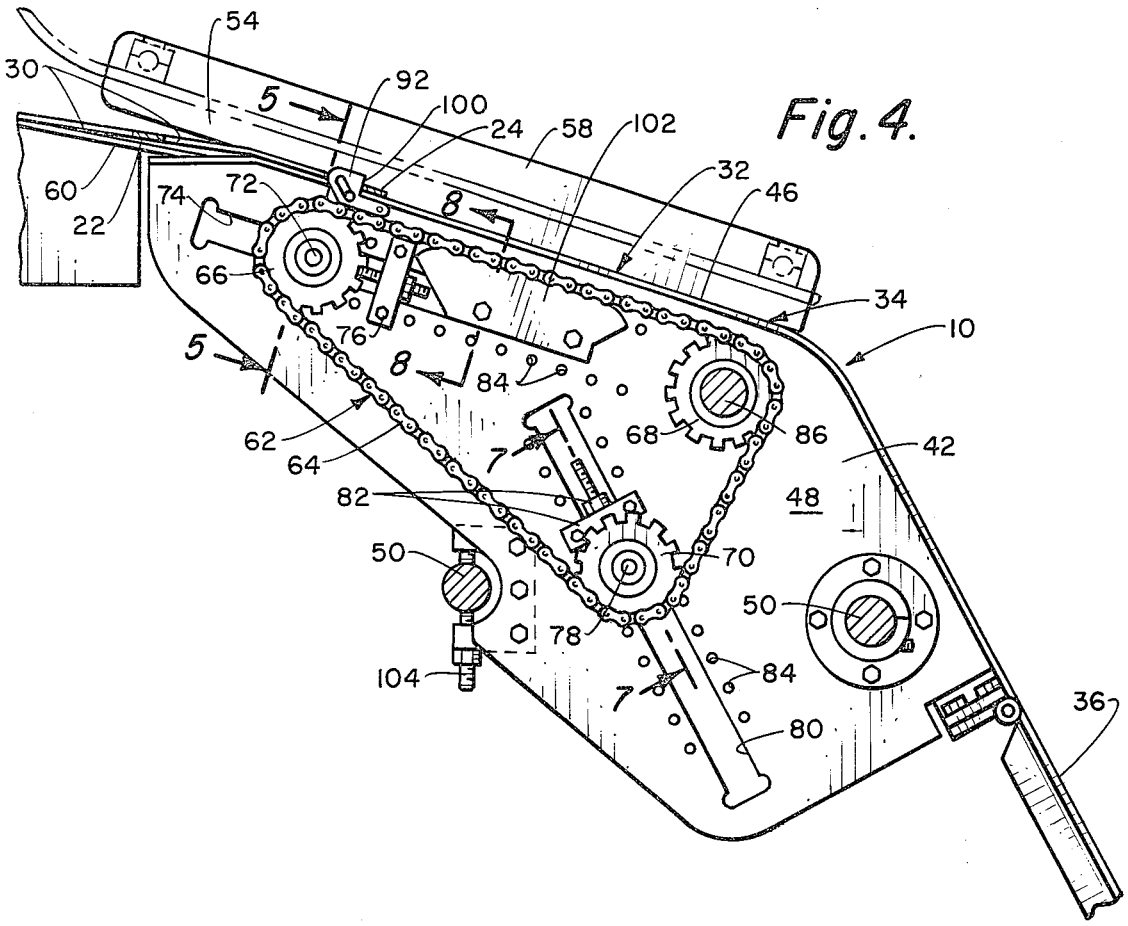
FIG. 4 is a fragmentary, vertical sectional view looking in the direction of the arrows 4—4 in FIG. 2.

As best seen in FIGS. 2 and 4, the sheet support tray 32 is made up of outer pairs of selectively transversely adjustable support segments 42 and a central stationary pair of support segments 44. These support segments 42 and 44 have generally horizontal portions 46 forming parts of the support surface 34 and generally vertical portions 48 transversely adjustably supported or supported stationary, as is appropriate, on the transverse mounting bars 50 extending between and secured to side plates 52. The support tray extension 36 is merely formed by hinged extensions of the support segments 42 and 44.

Also transversely adjustably mounted on the mounting bars 50 are the sheet edge guides 54 transversely outwardly adjacent the outermost of the support segments 42 and having longitudinal guide surfaces 56 projecting vertically upwardly above the sheet support surface 34. Furthermore, an upper sheet guide 58 is supported transversely between the side plates 52 spaced above and generally parallel to the sheet support surface 34 thereby defining a generally horizontal slot through the generally horizontal part of the skeleton discharge mechanism 10 through which the scrap skeleton sheets 22 may pass. The longitudinal path of travel of the scrap skeleton sheets 22 from the press 12 to the skeleton discharge mechanism 10 is completed by a transfer tray 60 extending longitudinally between the die surface 16 and the sheet support surface 34.

The important sheet transportation means of the skeleton discharge mechanism 10, that is, that part which actually engages and physically moves the scrap skeleton sheets 22 through the mechanism and through final discharge, is formed by a pair of transversely spaced and longitudinally movable engagement devices generally indicated at 62. One is operably mounted transversely inwardly adjacent and connected to each of the transversely outermost of the outer support segments 42 forming parts of the sheet support tray 32. Furthermore, these engagement devices 62 are substantially the same so that a description of one will suffice for the other.

Figure 6:
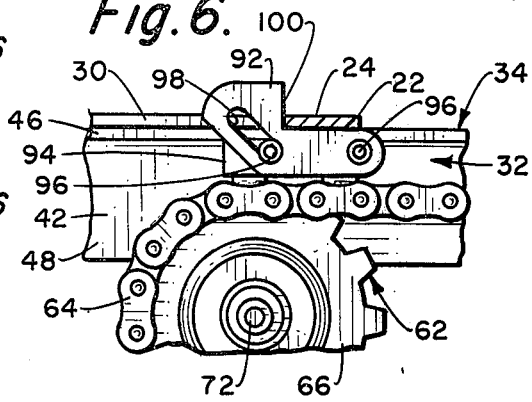
FIG. 6 is a fragmentary, side elevational view, part an vertical section, looking in the direction of the arrows 6—6 in FIG. 5.
Figure 7:
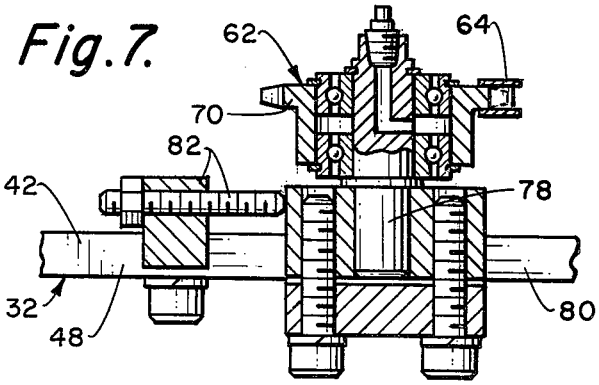
FIG. 7 is an enlarged, fragmentary, vertical sectional view looking in the direction of the arrows 7—7 in FIG. 4.
Figure 8:
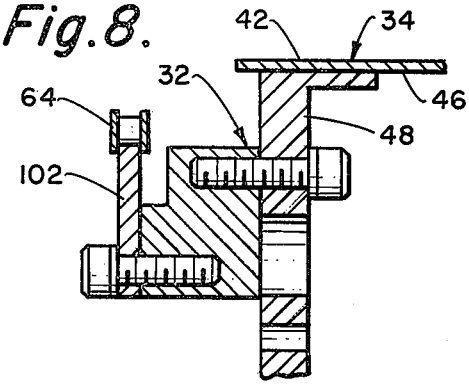
FIG. 8 is an enlarged, fragmentary, vertical sectional view looking in the direction of the arrows 8—8 in FIG. 4.

Referring for the moment to FIGS. 4 through 8, each of the engagement devices 62 includes a generally longitudinally extending chain 64 movable in a continuous or closed longitudinal path over a multiplicity of rotatable sprockets, an upper forward idler sprocket 66, an upper rearward drive sprocket 68 and a lower rearward idler sprocket 70. As probably best seen in FIG. 5, the forward idler sprocket 66 is rotatably connected to the vertical portion 48 of the particular outer support segment 42 through a somewhat usual bearing block arrangement 72, but important to the principals of the present invention, such bearing block arrangement is selectively horizontally adjustably mounted in an adjustment slot 74 of the outer support segment 42 and retained in its adjusted position by a block and threaded pin retainer 76 (FIG. 4). As shown in FIG. 7, the rearward idler sprocket 70 is similarly mounted through a bearing block arrangement 78 adjustable in an adjustment slot 80 of the particular outer support segment 42 through a block and threaded pin retainer 82, slot 80 angling between vertical and horizontal as seen in FIG. 4. In each case, the retainers 76 and 82 are provided with a series of spaced securement holes 84 for providing selective initial positioning of these retainers so that the overall adjustment of the forward and rearward idler sprockets 66 and 70 is over a relatively wide range.

The rearward drive sprocket 68 is mounted longitudinally aligned with the forward and rearward idler sprockets 66 and 70 by securement thereof on a transverse rotatable drive shaft 86, this drive shaft having both of the rearward drive sprockets 68 of the two engagement devices 62 secured thereto and rotatable therewith. As can be seen in FIG. 2, the drive shaft 86 is rotatably mounted on and extending transversely between the side plates 52 and is connected at one end thereof through a drive chain 88, shown in hidden lines in FIG. 3, to an appropriate power take-off 90 of the press 12. Thus, with this drive arrangement, the engagement devices 62 of the skeleton discharge mechanism 10 are driven in exact timing with the operation of the press 12, the driving rotation of the rearward drive sprockets 68 precisely simultaneously moving the chains 64 in their continuous or closed paths of travel.

As clearly shown in FIGS. 2 through 6, each of the chains 64 of the engagement devices 62 has a pair of tranversely spaced engagement members or fingers 92 secured thereto at precisely transversely aligned longitudinal locations and exactly movable therewith. In each case, the pair of engagement fingers 92 are secured to longitudinally spaced blocks 94 through transverse pins 96 with the blocks connected to longitudinally adjacent links of the particular chain 64. Also in each case, the trailing of the pins 96 is slideably connected to its engagement fingers 92 through an angled slot 98 thereby permitting full flexing of the particular chain 64 as it passes more sharply around the various sprockets 66, 68 and 70.

More important to the direct functioning of the engagement devices 62, the centers of rotation of the forward idler and rearward drive sprockets 66 and 68 are at all times maintained properly aligned with the sheet support surface 34 of the sheet support tray 32 so that all of the engagement fingers 92 project upwardly through the sheet support surface at all times that the engagement fingers are above and longitudinally between the centers of these sprockets. Furthermore, the engagement fingers 92 each have generally vertically projecting engagement surfaces 100 facing rearwardly when the engagement fingers are so positioned and preferably vertically extending to spaced above the sheet support surface 34. A chain ride plate 102 is secured transversely adjacent each of the appropriate outer support segments 42 longitudinally spanning a large segment of the longitudinal distance between the forward idler and rearward drive sprockets 66 and 68 upon which each of the chains 64 slides (FIGS. 4 and 8) for maintaining the described projection of the engagement fingers 92 and their engagement surfaces 100 thereof during their upper movement between the forward idler and rearward drive sprockets.

Thus, with the chains 64 being simultaneously driven in clockwise rotation as viewed in FIGS. 4 and 6, as the engagement fingers 92 pass forwardly around the forward idler sprockets 66 they move upwardly through the sheet support surface 34 presenting their engagement surfaces 100 at an exact predetermined longitudinal location which constitutes the sheet pick-up station and these engagement fingers will maintain their engagement surfaces 100 projecting through and above the sheet support surface, that is, between the pairs of outer support segments 42, until the chains have moved the engagement fingers rearwardly above the rearward drive sprockets 68. Continued movements of the chains 64 will then begin to move the engagement fingers 92 downwardly away from and withdrawing from their projection through the sheet support surface 34. The engagement fingers 92 will remain spaced away from the sheet support surface 34 until they have once again returned to the forward idler sprockets 66 and are carried upwardly for reintroduction through the sheet support surface at the pick-up station.

The exact longitudinal location of the pick-up station, that is, the location at which the engagement fingers 92 have first projected nearly or fully their engagement surfaces 100 a maximum projection above the sheet support surface 34 will be determined by the distance that the particular press 12 positions the leading end portion 24 of a scrap skeleton sheet 22 into the entrance portion of the sheet support tray 32 and along the sheet support surface 34 during the last indexing of a particular scrap skeleton sheet and the last press working stroke thereon. This final positioning of the scrap skeleton sheet 22 by the press 12 may be coordinated with the effective movement of the engagement fingers 92 determining the pick-up station by the described selective adjustment of the forward idler sprocket 66 in the adjustment slot 74 with cooperable selective adjustment of the rearward idler sprocket 70 in its adjustment slot 80 for maintaining the particular chain 64 properly tensioned. At the same time, the effective upward projection of the engagement fingers 92 while projecting through the sheet support surface 34 may be selectively adjustably regulated by the adjustment screws 104 between the forward of the mounting bars 50 and the outer support segments 42 upon which the engagement devices 62 are mounted.

In operation of the described embodiment of the skeleton discharge mechanism 10 of the present invention, and assuming that the same is mounted on the can cupmaker blank and draw press 12 hereinbefore briefly described and is properly adjusted to function therewith, the press with its fifth index of and its fifth working stroke on a scrap skeleton sheet 22 would position the scrap skeleton sheet with the leading end portion 24 thereof extending exactly into the entrance portion of the sheet support tray 32 positioned on the sheet support surface 34 as particularly shown in FIGS. 2 and 4. In such position, the leading or forwardmost transverse row of part openings 30 will have the part opening forward extremities precisely at the pick-up station and the scrap skeleton sheet 22 will be confined on the sheet support surface 34 transversely between the properly selectively adjusted sheet edge guides 54. Upon the upward stroke of the rams 20 on the press 12, which disengages the scrap skeleton sheet 22 for discharge, the engagement fingers 92 of the engagement devices 62 will move forwardly and upwardly around the forward idler sprockets 66 projecting upwardly through the sheet support surface 34 and, again through proper transverse adjustment to be hereinafter discussed, will engage within the part openings 30 of the scrap skeleton sheet 22 against the scrap skeleton sheet at the part openings forward extremities in the positions shown in FIGS. 2, 4 and 6.

As the engagement fingers 92 continue their movements, now rearwardly and above and between the forward idler and rearward drive sprockets 66 and 68 while projecting upwardly through the sheet support surface 34 into engagement with the scrap skeleton sheet 22, these engagement fingers will pull or drag the scrap skeleton sheet rearwardly along the sheet support surface 34 ultimately disengaging the same at the rearward sprockets 68 by withdrawing downwardly from the sheet support surface 34. This movement of the engagement fingers 92, however, will supply sufficient motion to the scrap skeleton sheet 22 so that when the scrap skeleton sheet is disengaged by the engagement fingers, the scrap skeleton sheet will continue its rearward motion now downwardly along the downwardly angled portion of the sheet support surface 34, along the support tray extension 36 and ultimately into the bin 40 (FIG. 1). Once the engagement fingers 92 have disengaged that particular scrap skeleton sheet 22, they will continue their closed path of travel moving forwardly spaced downwardly from the sheet support surface 34 ultimately arriving back at the forward idler sprockets 66 coming up into the pick-up station once again to similarly engage the next scrap skeleton sheet 22 which has not been placed at the pick-up station by the press 12.

One complete closed path movement of the engagement fingers 92 must, of course, be closely timed with the operation of the press 12 so that the engagement fingers 92 make one complete closed path circumvention while the press 12 carries out the five sheet indexes and blank and draw strokes to properly present a scrap skeleton sheet 22 at the pick-up station for discharge from the press. To avoid complicated timing devices and switching, and to provide maximum simplicity, it is preferred that the drive arrangement provided by the power take-off 90 between the press 12 and the skeleton discharge mechanism 10 will maintain continuous movement of the engagement fingers 92 throughout their closed path movements timed exactly with the indexing and strokes of the press 12 so that each scrap skeleton sheet 22 is engaged and discharged at the exact proper time. Furthermore, with the scrap skeleton sheets 22 being engaged at their leading end portions 24 and pulled or dragged from the press 12 to discharge, this exact timing can always be maintained despite the fragility of the scrap skeleton sheets 22 caused by the maximum number of part openings 30 having been formed therein.

If it is desired to install a different blanking die or a different blank and draw die in the press 12, or make use of the skeleton discharge mechanism 10 with a different press, in either case where a different size scrap skeleton sheet will be produced or one having a different pattern of part openings therein, the skeleton discharge mechanism maybe conveniently adjusted to either selectively change the exact longitudinal location of the pick-up station and/or the exact transverse locations of the engagement finger movements and/or the exact positions of the sheet edge guides 54. The exact position of the pick-up station may be selectively changed as hereinbefore discussed relative to the original location thereof merely by the forward or rearward selective adjustment of the forward idler sprocket 66 with the comparable adjustment of the rearward idler sprocket 70. The transverse locations of the engagement fingers 92 may be simply adjusted by transverse adjustment of the outermost outer support segments 42 along the mounting bars 50 with corresponding transverse adjustment of the rearward drive sprockets 68 along the drive shaft 86. The sheet edge guides 54 maybe similarly transversely adjusted to exactly guides 54 may be similarly transversely adjusted to exactly place their guide surfaces 56.

Thus, it is seen that the skeleton discharge mechanism 10 of the present invention is quite versatile and readily adaptable to various dies and various presses within reasonable limits. For instance, the particular embodiment of the skeleton discharge mechanism 10 illustrated herein has been constructed capable of selective adjustment for any size of scrap skeleton sheet 22 from 36 to 44 inches long, and any sheet width from 18 to 42 inches and any diameter of the part openings 30 from 4 to 9 inches. This, of course, is merely an example and it is clearly evident that virtually any desired adjustability could be provided within reasonable limits.

According to the present invention, therefore, a unique skeleton discharge mechanism 10 is provided which, most importantly, accomplishes the positive discharge of scrap skeleton sheets 22 from a press 12 by securely engaging leading end portions 24 thereof and pulling or dragging the same through the mechanism and to final discharge despite the inherent fragility of such scrap skeleton sheets. Furthermore, for maximum simplicity, the skeleton discharge mechanism 10 may be formed with the important engagement devices 62 thereof continuously movable in their closed paths of movement during their discharging functions only requiring simple power take-off timing with the particular press 12 and eliminating the necessity for any complex timing and switching controls which would be necessitated in stop and go movements. Also, the skeleton discharge mechanism 10 of the present invention maybe further formed for maximum selective adjustment thereof to adapt the same to different die arrangements and different presses, either of which might produce scrap skeleton sheets 22 of different sizes or shapes thereby adding the maximum of versatility within reasonable limits.

I claim:

1. In a skeleton discharge mechanism for use with cupmaker blank and draw presses and the like of the type wherein the leading edge portions of completed scrap skeleton sheets, having precisely located hole means formed therethrough, are consecutively positioned ready for discharge on an exact timed basis by the press extending longitudinally into an entrance portion of the skeleton discharge mechanism; such that said hole means is positioned precisely at a pick-up station of said skeleton discharge mechanism entrance portion; the combination of: scrap sheet support means comprising a support surface projecting longitudinally away from said press between said entrance portion and an exit portion spaced away from said press for supporting said scrap skeleton sheet movable longitudinally therealong; sheet transportation means for longitudinally moving said scrap skeleton sheet along said support surface of said scrap sheet support means between said entrance and exit portions comprising a sheet engagement member, mounting means for mounting said engagement member movable on an exact timed basis in a closed longitudinal path to said entrance portion pick-up station of said support surface into sheet engagement only exactly through said hole means of said sheet leading edge portion and then longitudinally along said support surface to said exit portion pulling said sheet solely by said hole means engagement and then to spaced from said support surface disengaging said sheet and ultimately back to said entrance portion pick-up station of said support surface, said mounting means including means for selectively adjusting said engagement member closed longitudinal path of movement to selectively vary the exact longitudinal location along said support surface entrance portion to which said engagement member is moved into said sheet leading edge portion hole means engagement thereby varying the exact longitudinal location along said support surface entrance portion of said pick-up station constituting said exact predetermined location and adapting said engagement member and mounting means to hole means engaging and pulling scrap skeleton sheet of different longitudinal lengths.

2. In a skeleton discharge mechanism as defined in claim 1 in which said scrap sheet support means further comprises selectively transversely adjustable sheet guides at sides of said support surface positioned for guiding said scrap skeleton sheets movable longitudinally away from said press along said support surface, selective transverse adjustment of said sheet guides adapting said scrap sheet support means for scrap skeleton sheets of different transverse size.

3. In a skeleton discharge mechanism as defined in claim 1 in which said mounting means for mounting said engagement member movable and for selective adjustment of said closed longitudinal path of movement includes a chain having said engagement member secured movable therewith, a set of sprockets positioned mounting said chain and thereby said engagement member movable in said closed longitudinal path, selectively adjustable means for selectively varying the position of said sprockets to vary the exact longitudinal location of chain movement of said engagement member to said support surface entrance portion thereby selectively varying said closed longitudinal path of movement and the exact longitudinal location at said support surface entrance portion of said pick-up station constituting said exact predetermined location adapting said engagement member and mounting means to hole means engaging and pulling scrap skeleton sheets of different longitudinal lengths.

4. In a skeleton discharge mechanism as defined in claim 1 in which said mounting means for mounting said engagement member movable and for selective adjustment of said closed longitudinal path of movement includes a chain movable over a multiplicity of sprockets and having said engagement member connected movable therewith, said sprockets being positioned directing said chain and thereby said engagement member in said closed longitudinal path to said entrance portion pick-up station constituting said exact predetermined location projecting at least partially through said support surface into said sheet engagement and then longitudinally along said support surface continuing said projection to said exit portion and then to spaced from said support surface and from said projection, means for selectively adjusting said sprocket positioning relative to said support surface thereby selectively varying said chain and engagement member closed longitudinal path of movement to selectively vary the exact longitudinal location along said support surface entrance portion to which said engagement member is moved into said sheet leading edge portion hole means engagement therey varying the exact longitudinal location along said support surface entrance portion of said pick-up station constituting said exact predetermined location and adapting said chain and engagement member to scrap skeleton sheets of different longitudinal lengths.

* * * * *